US005926139A

United States Patent [19]

Korisch

[11] Patent Number: 5,926,139

[45] Date of Patent: Jul. 20, 1999

[54] PLANAR DUAL FREQUENCY BAND ANTENNA

[75] Inventor: Ilya A. Korisch, Eatontown, N.J.

[73] Assignee: Lucent Technologies Inc., Murray Hill, N.J.

[21] Appl. No.: 08/887,021

[22] Filed: Jul. 2, 1997

[51] Int. Cl.[6] ..... H01Q 1/27

[52] U.S. Cl. ..... 343/702; 343/700 MS; 343/718; 343/725

[58] Field of Search ..... 343/700 MS, 702, 343/718, 725, 843

[56] References Cited

U.S. PATENT DOCUMENTS

| | | | |
|---|---|---|---|
| 5,483,249 | 1/1996 | Kennedy | 343/700 MS |
| 5,526,003 | 6/1996 | Ogawa | 343/700 MS |
| 5,541,610 | 7/1996 | Imanishi | 343/702 |
| 5,550,554 | 8/1996 | Erkocevic | 343/702 |
| 5,627,551 | 5/1997 | Tsura | 343/700 MS |
| 5,691,732 | 11/1997 | Tsura | 343/702 |
| 5,764,190 | 7/1996 | Murch | 343/702 |
| 5,786,793 | 7/1998 | Maeda | 343/700 MS |

OTHER PUBLICATIONS

T. Taga and K. Tsunekawa "Performance Analysis of a Built-in Planar Inverted-F Antenna for 800 MHz Band Radio Units Case", IEEE J. Select. Areas Commun., vol. SCA-5, No. 5, pp. 921-929, 1987.

IEEE Antennas and Propagation Society International Symposium/1996 Digest Jul. 21-26, 1996 Baltimore, MD vol. 1, pp. 54-57.

*Primary Examiner*—Hoanganh Le
*Assistant Examiner*—James Clinger

[57] ABSTRACT

A single planar antenna for use in two frequency bands includes radiating portions for the two bands joined by a connecting portion and spaced from a ground plane. Each radiating portion is formed as a planar inverted F-antenna. A grounding pin interconnects the connecting portion and the ground plane and a single feed pin connects the connecting portion to the input/output port of transceiver circuitry.

5 Claims, 2 Drawing Sheets

PLANAR DUAL FREQUENCY BAND ANTENNA

BACKGROUND OF THE INVENTION

This invention relates to an antenna operable in two frequency bands and, more particularly, to a planar dual frequency band antenna for use in a handheld communications device.

In recent years, portable handheld wireless communications devices have become increasingly popular. At the present time, cellular telephones operating in the frequency band of 824 MHz through 896 MHz are the most widespread type of such devices. However, the personal communications system (PCS) operating in the frequency band of 1850 MHz through 1990 MHz is gaining in popularity. Accordingly, equipment suppliers are developing portable handheld radio transceivers which operate in both these frequency bands. Thus, there exists a need for an antenna capable of operating in both of the described frequency bands.

Handheld portable radio transceivers must be designed in accordance with certain human factors considerations. Thus, such a device should be compact and lightweight. It is known to design such a device with a rod (or whip) antenna which is selectively retractable into, or extendable out of, the device case. It is also known to design such a device with a short fixed helical antenna extending out of the device case. However, such an extending antenna possesses certain disadvantages. Thus, for example, having an antenna extending out of the case detracts from the smooth contours of the case. Further, such an antenna can present problems when placing the transceiver into a user's pocket or purse. Thus, there exists a further need for a dual frequency antenna which does not suffer from the foregoing disadvantages.

It is known to provide such transceivers with two antennas. One of the antennas (the primary antenna) is used for both transmitting and receiving signals. The other antenna (the diversity antenna) is used only for receiving signals. The received signals from both of the antennas are added together according to a certain known scheme. The use of a diversity antenna is intended to mitigate the effects of multipath fading. The general idea is that if two incoming waves are out of phase and cancel each other on one antenna, on the other antenna this cancellation will not occur or will not be as complete. In order to achieve this effect, the two received signals must be statistically uncorrelated. It would not be desirable to have two extending antennas on the device because this would be unaesthetic. More importantly, for the diversity scheme to function, the two antennas either have to be placed far from each other, which is impossible considering the size of the handheld device, or they have to be as different as possible, providing different antenna patterns. It is known to provide a planar inverted F-antenna as a diversity antenna on a handheld transceiver, but all such known devices have been only for a single frequency band. Thus, there exists another need for a dual frequency antenna which can be utilized as a diversity antenna.

SUMMARY OF THE INVENTION

In accordance with the principles of this invention, there is provided a planar dual frequency band antenna for use in a radio transceiver device. The inventive antenna comprises a planar dielectric substrate having first and second major surfaces and a first layer of conductive material on the first major surface of the substrate to function as a ground plane for the antenna. A unitary second layer of conductive material is disposed on the second major surface of the substrate to function as a radiating element for the antenna. The second layer has a first radiating portion shaped and sized to function as a first planar inverted F-antenna for a first of the frequency bands, a second radiating portion shaped and sized to function as a second planar inverted F-antenna for the second of the frequency bands, and a connecting portion joining the first and second radiating portions of the second layer. A grounding pin extends through the substrate and interconnects the first layer and the connecting portion of the second layer. A feed pin is connected to the connecting portion of the second layer and is coupled to circuitry of the radio transceiver device.

In accordance with an aspect of this invention, the second layer has an overall configuration shaped generally like the letter J.

In accordance with another aspect of this invention, at least one of the first and second radiating portions of the second layer meanders.

BRIEF DESCRIPTION OF THE DRAWINGS

The foregoing will be more readily apparent upon reading the following description in conjunction with the drawings in which like elements in different figures thereof are identified by the same reference numeral and wherein.

DETAILED DESCRIPTION

Figure 1:
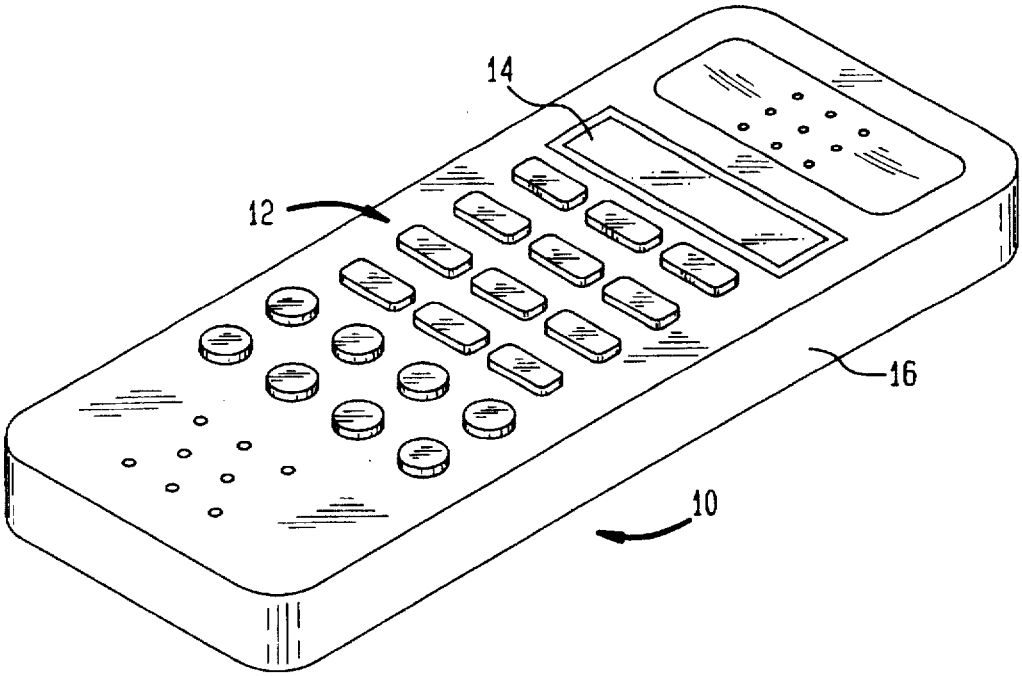
FIG. 1 is a perspective view of a handheld communications device in which an antenna constructed in accordance with the principles of this invention is incorporated.

Referring now to the drawings, FIG. 1 shows a handheld portable communications device, designated generally by the reference numeral 10, having a data entry keypad 12 and a display 14 disposed on one surface of the insulative case 16. The device 10 includes a radio transceiver operable in two frequency bands. As will be described in full detail hereinafter, an antenna according to the present invention operable in those bands is also incorporated in the device 10.

Figure 2:
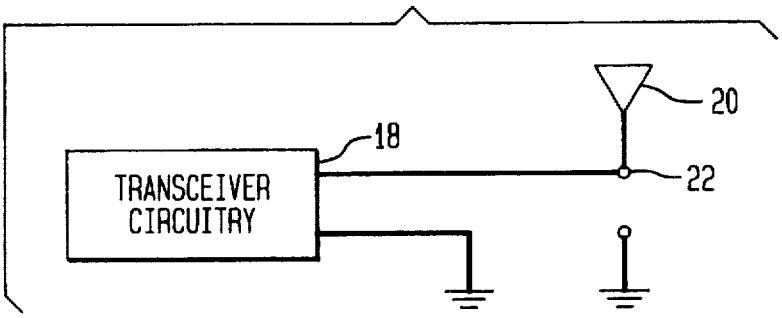
FIG. 2 is a block diagram illustrating the connection of the antenna to the transceiver circuitry of the communications device of FIG. 1.

FIG. 2 illustrates how the transceiver circuitry 18 within the case 16 is coupled to the antenna 20. As shown, it is conventional that the transceiver circuitry 18 has a single input/output port 22 for both frequency bands. It is known to provide two separate planar antennas on the side of the case 16, one for each frequency band. However, this requires a redesign of the transceiver circuitry 18 to provide separate input/output ports for the two bands. In addition, the use of two separate antennas requires multiple grounding pins, which requires additional space on the printed circuit board holding the transceiver circuitry 18. The present invention overcomes these disadvantages.

Figure 3:
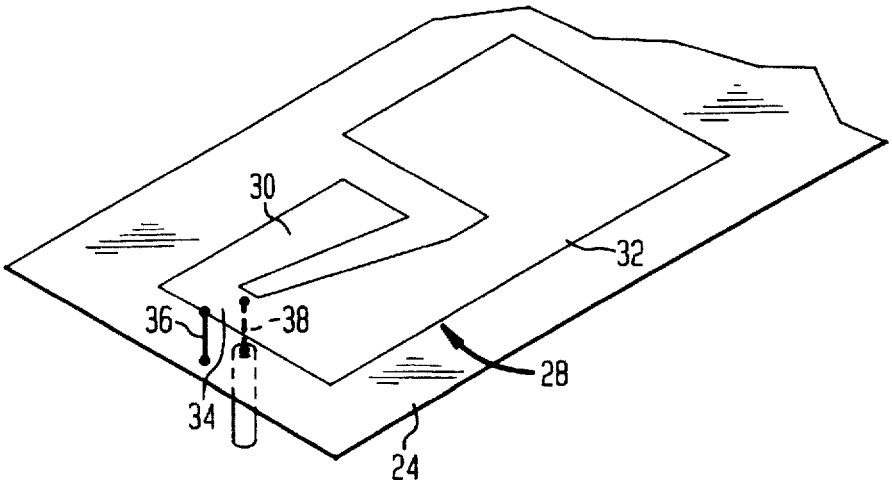
FIG. 3 illustrates a first embodiment of an antenna configuration according to the present invention.
Figure 5:
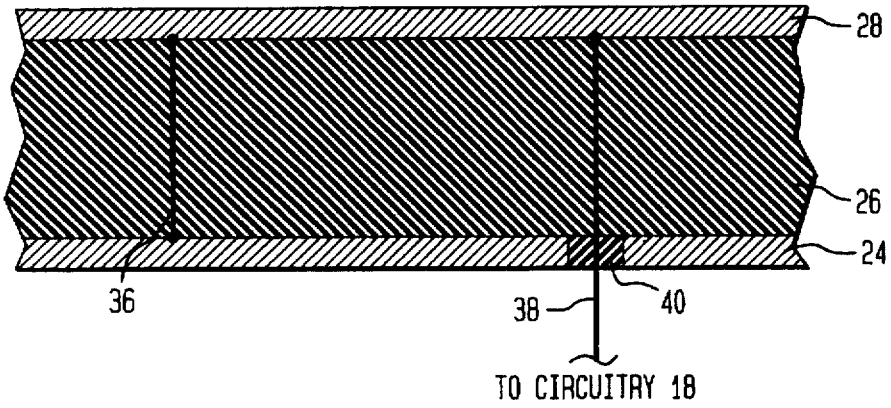
FIG. 5 is a partial cross sectional view through the antenna according to the present invention showing the connections of the grounding pin and the feed pin.

FIG. 3 shows the two conductive layers of the antenna according to this invention without the intermediate planar dielectric substrate (which is shown in FIG. 5). These layers are each deposited on a respective major surface of the substrate. Thus, the inventive antenna includes a first layer of conductive material 24 which functions as a ground plane for the antenna. This layer 24 is on the lower surface of the planar dielectric substrate 26 (FIG. 5). On the upper surface of the dielectric substrate 26 is a unitary second layer 28 of conductive material which functions as a radiating element for the antenna. The second layer 28 includes a first radiating portion 30 shaped and sized to function as a first planar inverted F-antenna for a first of the frequency bands and a second radiating portion 32 shaped and sized to function as a second planar inverted F-antenna for the second of the frequency bands. As shown, the first radiating portion 30 is smaller than the second radiating portion 32 and functions as the antenna for the higher of the two frequency bands. The second layer 28 further includes a connecting portion 34 joining the first radiating portion 30 and the second radiating portion 32.

A grounding pin 36 extends through the dielectric substrate 26 and interconnects the ground plane 24 and the connecting portion 34 of the radiating element 28. A feed pin 38 extends through the ground plane 24 and the substrate 26 to couple the radiating element 28 to the transceiver circuitry 18. Where the feed pin 38 extends through the conductive layer 24, it is insulated from the conductive layer 24 by an insulating via 40. Although the feed pin 38 is shown as extending through the ground plane 24, it is understood that there may be a situation where the circuitry 18 is on the same side of the ground plane 24 as the radiating element 28. In such a situation, the feed pin 38 will not pass through the ground plane 24, but in all cases the feed pin 38 must be electrically insulated from the ground plane 24.

Figure 4:
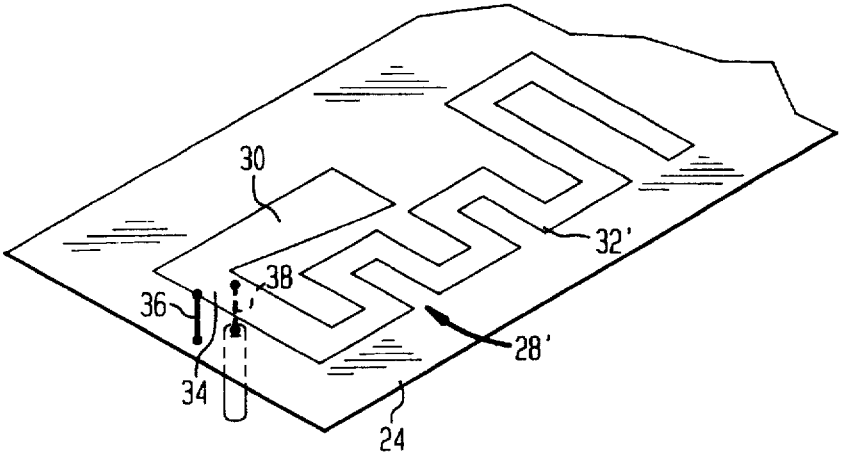
FIG. 4 illustrates a second embodiment of an antenna configuration according to the present invention.

As shown, the radiating element 28 is shaped generally like the letter J. Each of the radiating portions 30, 32 extends from its connection to the feed pin 38 approximately one quarter of the wavelength at the center frequency of its respective frequency band. This extent includes the length, width and height of the respective radiating portion. In the embodiment shown in FIG. 4, the radiating portion 32' of the radiating element 28' meanders, as contrasted with the substantially "straight" radiating portion 32 shown in FIG. 3. This provides increased length for the radiating portion 32'.

The spacing between the grounding pin 36 and the feed pin 38 is selected to maintain the antenna impedance at approximately 50 ohms for both frequency bands. For the lower frequency band, the shorter radiating portion 30 provides a very high impedance so it doesn't load the longer radiating portion 32. Similarly, for the high frequency band, the longer radiating portion 32 provides a very high impedance so it doesn't load the shorter radiating portion 30.

Figure 6:
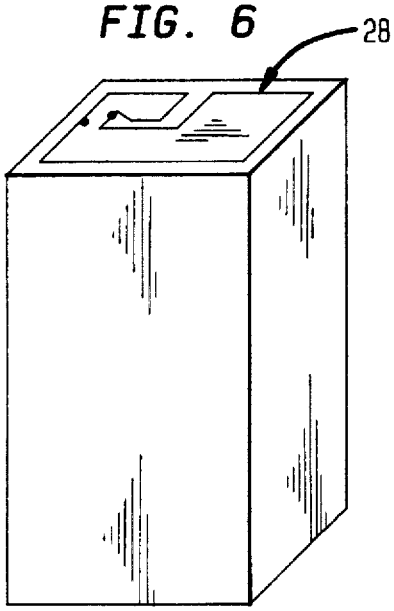
FIGS. 6 and 7 schematically illustrate alternative placements for the antenna according to the present invention relative to the communications device of FIG. 1.
Figure 7:
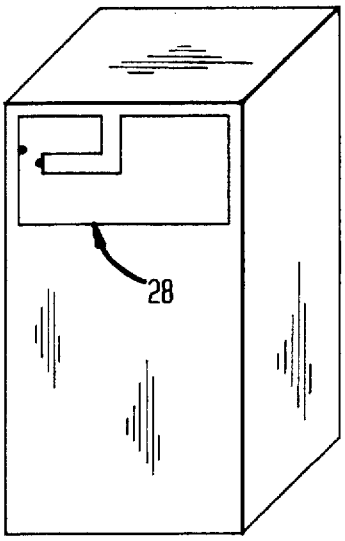

FIGS. 6 and 7 schematically illustrate two alternative placements for the antenna according to this invention. Both placements are within the case 16. As shown in FIG. 6, the antenna can be mounted below the top surface of the case 16. As shown in FIG. 7, the antenna can be mounted below the rear surface of the case 16 near the upper end thereof. Both of the illustrated placements minimize the power absorbed by the hand of the user of the communications device 10.

Accordingly, there has been disclosed an improved planar dual frequency band antenna for use in a handheld communications device. The inventive antenna has a single feed for both frequency bands and results in reduced cabling as compared with separate antennas for each of the frequency bands. While alternative embodiments of this invention have been disclosed herein, it is understood that various adaptations to the disclosed embodiments are possible and will be apparent to one of ordinary skill in the art, and it is intended that this invention be limited only by the scope of the appended claims.

What is claimed is:

1. A planar dual frequency band antenna for use in a radio transceiver device comprising:

a planar dielectric substrate having first and second major surfaces;

a first layer of conductive material on the first major surface of said substrate to function as a ground plane for the antenna;

a unitary second layer of conductive material on the second major surface of said substrate to function as a radiating element for the antenna, the second layer having a first radiating portion shaped and sized to function as a first planar inverted F-antenna for a first of the frequency bands, a second radiating portion shaped and sized to function as a second planar inverted F-antenna for the second of the frequency bands, and a connecting portion joining said first and second radiating portions of said second layer;

a grounding pin extending through said substrate and interconnecting said first layer and the connecting portion of said second layer; and a feed pin connected to said connecting portion of said second layer and coupled to circuitry of said radio transceiver device.

2. The antenna according to claim 1 wherein said second layer has an overall configuration shaped generally like the letter J.

3. The antenna according to claim 2 wherein at least one of said first and second radiating portions of said second layer meanders.

4. The antenna according to claim 1 wherein each of said radiating portions extends from said feed pin approximately one-quarter of the wavelength at the center frequency of the respective frequency band.

5. The antenna according to claim 1 wherein said feed pin extends through said first layer and said substrate and is insulated from said first layer.

* * * * *